US005142714A

United States Patent [19]

Klotzbach

[11] Patent Number: 5,142,714

[45] Date of Patent: Sep. 1, 1992

[54] WHIRLPOOL NOZZLE

[75] Inventor: Manfred Klotzbach, Düren, Fed. Rep. of Germany

[73] Assignee: Hoesch Metall & Kunststoffwerk GmbH & Co., Kreuzau-Schneidhausen, Fed. Rep. of Germany

[21] Appl. No.: 499,409

[22] PCT Filed: Oct. 11, 1989

[86] PCT No.: PCT/EP89/01199

§ 371 Date: Jun. 13, 1990

§ 102(e) Date: Jun. 13, 1990

[87] PCT Pub. No.: WO90/03774

PCT Pub. Date: Apr. 19, 1990

[30] Foreign Application Priority Data

Oct. 15, 1988 [DE] Fed. Rep. of Germany ... 8812993[U]

[51] Int. Cl.[5] ..... A61H 33/02

[52] U.S. Cl. ..... 4/542; 239/425.5

[58] Field of Search ..... 4/492, 541, 542, 544; 239/425.5, 428.5, 587

[56] References Cited

U.S. PATENT DOCUMENTS

| | | | |
|---|---|---|---|
| 3,471,091 | 10/1969 | Baker | 239/587 |
| 4,261,347 | 4/1981 | Spencer, III et al. | 239/428.5 X |
| 4,262,371 | 4/1981 | Berry et al. | 4/542 X |
| 4,408,721 | 10/1983 | Cohen et al. | 239/428.5 X |
| 4,671,463 | 6/1987 | Moreland et al. | 4/542 X |
| 4,731,887 | 3/1988 | Henkin et al. | 4/541 |
| 4,742,965 | 5/1988 | Messinger et al. | 239/587 X |
| 4,800,046 | 1/1989 | Malek et al. | 4/542 X |

FOREIGN PATENT DOCUMENTS

| | | | |
|---|---|---|---|
| 1026800 | 2/1978 | Canada | 4/542 |
| 0168823 | 1/1986 | European Pat. Off. . | |
| 215514 | 3/1987 | European Pat. Off. | 4/542 |
| 0320696 | 6/1989 | European Pat. Off. . | |

*Primary Examiner*—Henry J. Recla
*Assistant Examiner*—Robert M. Fetsuga
*Attorney, Agent, or Firm*—Spencer, Frank & Schneider

[57] ABSTRACT

A nozzle assembly for discharging a mixture of first and second fluids includes a housing having inlets for introducting the first and second fluids into the housing; and a sleeve disposed in and affixed to the housing and receiving the second fluid from one of the inlets. There is further provided a holding ring disposed in the housing and surrounding the sleeve. The holding ring may be displaced relative to the sleeve in a direction parallel to the sleeve length. A nozzle body is situated in the housing and has a spherical member surrounding the sleeve and a nozzle outlet member. The nozzle body has a sealing face situated inside the spherical member and cooperating with a spherical sealing face of the sleeve for determining therewith a variable annular gap constituting a flow passage area for the first fluid. The nozzle body is held captive in the holding ring and may pivot therein. The nozzle body and the holding ring move substantially as a unit upon longitudinal displacement of the holding ring. The size of the variable annular gap depends from the longitudinal position of the holding ring. The holding ring has a limit position in which the gap is reduced to zero by a sealing contact between the spherical sealing face of the sleeve and the sealing face of the nozzle body. In the limit position the center of the spherical member and the center of the spherical sealing face of the sleeve coincide.

6 Claims, 1 Drawing Sheet

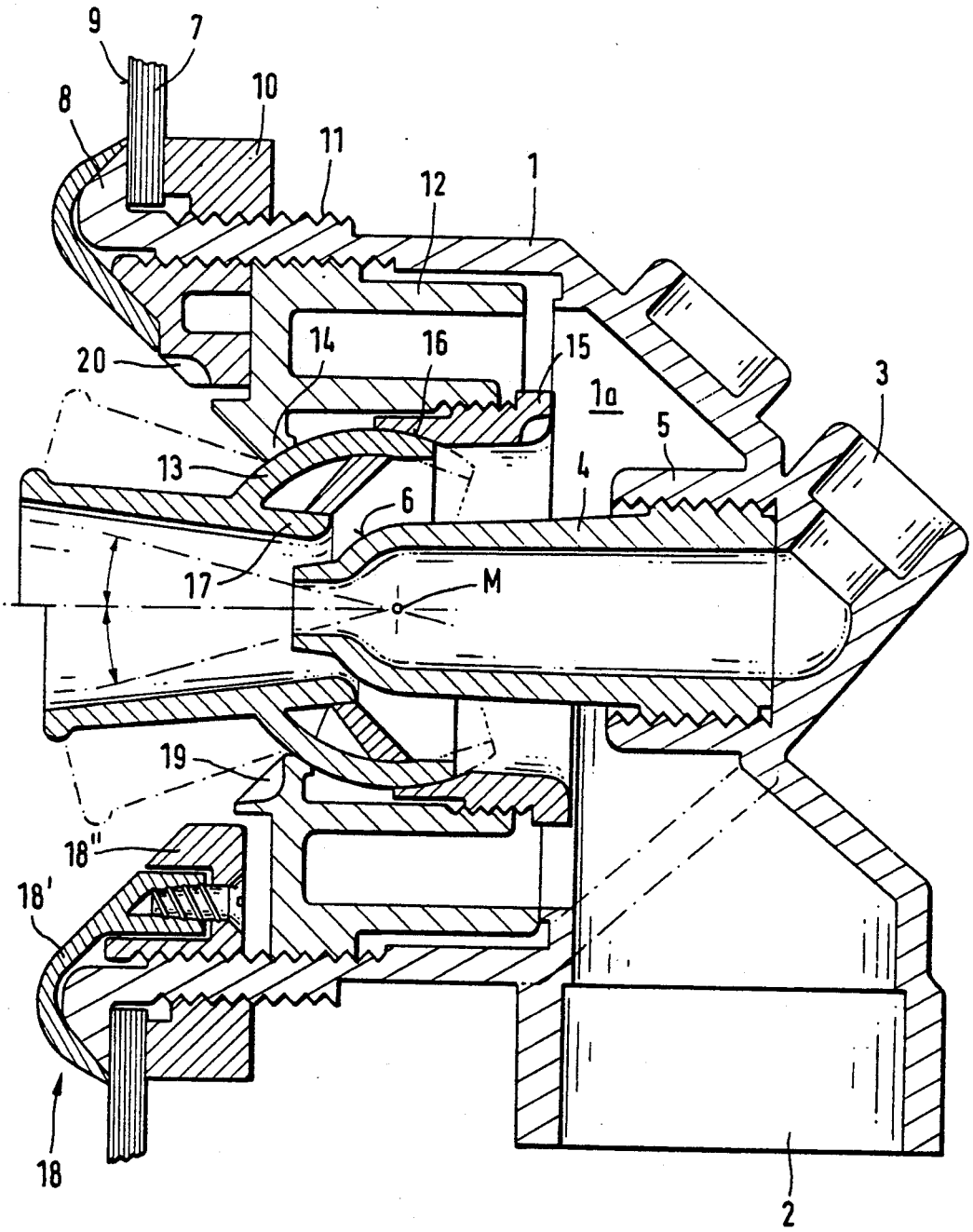
9
7
8
10
11
12
1
14
16
15
20
1a
3
5
13
4
6
17
M
19
18"
18'
18
2

WHIRLPOOL NOZZLE

The invention relates to a nozzle for introducing a mixture of water and air into a tub. The nozzle has an antechamber which may be coupled to an intake conduit for one medium, preferably the water, and which may be attached to the wall of the tub. A spherical nozzle body is pivotally held in the antechamber and is provided with a bore. The bore communicates with the antechamber and, from the exterior of the tub, an orifice of an intake conduit for the other medium, preferably the air, projects into the bore. Nozzles of this construction are known in principle.

However, nozzles of the above type have the drawback that, although the direction of the jet is adjustable, the mixing ratio between water and air can be regulated only by changing the rate of the intake air. While in expensive whirlpools the water throughput can be varied by regulating the pumping power, this cannot be accomplished, primarily for cost reasons, in simpler constructions so that the user is practically dependent on the water throughput predetermined by the pumping power and the nozzle dimensions. Another drawback of the known nozzle construction is that, when installed into the wall of the tub, the antechamber does not completely empty when the tub is emptied so that the danger of contamination of the remaining water exists.

SUMMARY OF THE INVENTION

It is the object of the invention to provide an improved nozzle of the above-outlined type which is more economical to make, which is simpler to install and service and which is capable of regulating the water throughput.

This object and others to become apparent as the specification progresses, are accomplished by the invention, according to which, briefly stated, the nozzle assembly for discharging a mixture of first and second fluids includes a housing having inlets for introducing the first and second fluids into the housing; and a sleeve disposed in and affixed to the housing and receiving the second fluid from one of the inlets. There is further provided a holding ring disposed in the housing and surrounding the sleeve. The holding ring may be displaced relative to the sleeve in a direction parallel to the sleeve length. A nozzle body is situated in the housing and has a spherical member surrounding the sleeve and a nozzle outlet member. The nozzle body has a sealing face situated inside the spherical member and cooperating with a spherical sealing face of the sleeve for determining therewith a variable annular gap constituting a flow passage area for the first fluid. The nozzle body is held captive in the holding ring and may pivot therein. The nozzle body and the holding ring move substantially as a unit upon longitudinal displacement of the holding ring. The size of the variable annular gap depends from the longitudinal position of the holding ring. The holding ring has a limit position in which the gap is reduced to zero by a sealing contact between the spherical sealing face of the sleeve and the sealing face of the nozzle body. In the limit position the center of the spherical member and the center of the spherical sealing face of the sleeve coincide.

The advantage of the arrangement according to the invention is that the nozzle can be inserted as a complete component from the interior of the tub through a corresponding bore, with the edge projecting over the opening edge in the tub lying in sealing contact against the interior of the tub so that it can be reliably sealed. If a leak should later develop, it is easily possible, even in an enclosed tub which is no longer accessible from the side, to produce the appropriate seal. Another advantage of the construction according to the invention is that axial displacement of the nozzle body relative to the orifice of the air intake conduit enables the free passage cross section for the one medium, preferably for the water, to be varied independently of the pumping power. Thus it is not only possible to regulate the supply of air, which is generally drawn in only on the basis of the Venturi effect through the orifice of the intake conduit opening into the nozzle and which can be regulated by changing the suction cross section, but it is also possible to regulate the throughput of the other medium, namely the water. The possibility of making adjustments is provided on the basis of the sealing surfaces in such a manner that it is also possible to completely seal off the antechamber against the interior of the tub so that the respective tub can also be employed for a normal cleansing bath without its water content being able to flow into the conduit system leading to the pump. In a preferred embodiment it is provided that the center point of the spherical surface of the orifice of the intake conduit for the other medium and the center point of the spherical body approximately coincide if the sealing face is in contact. In this way it is ensured that it is possible to completely seal the antechamber against the interior of the tub within the permissible pivoting range of the nozzle body in every desired angular position.

According to a further feature of the invention which results in a simple structure and is effective in sealingly supporting the spherical body, a reliable seal is provided by way of the supporting and sealing face of a screwable adjustment ring and by way of the contact pressure which is adjustable by way of the adjustment ring.

As an expedient feature it is provided that the bottom side of the antechamber is connected with the intake conduit for the one medium, preferably the water. In this way it is ensured that, upon completion of use, the intake conduit system can be emptied completely. As another expedient feature, it is provided that the intake conduit for the other medium, preferably the air, is connected to the antechamber so as to extend at an angle from the top to the bottom. In this way, it is ensured that only the immediate orifice region of the intake conduit is able to fill with water when the pump is taken out of operation.

As a particularly expedient feature of the invention, a decorative covering ring is provided for the edge of the antechamber projecting beyond the inner wall of the tub; this ring is held at the interior wall of the antechamber. As a further feature, the decorative covering ring is attached to the antechamber by a threaded connection. The decorative covering ring can produce a further, additional seal between the interior of the tub and the exterior of the tub. If, during later operation, a leak should develop in an enclosed tub, it will be possible to provide an invisible but effective seal by way of an appropriate layer of putty between the decorative covering ring and the projecting edge of the antechamber.

BRIEF DESCRIPTION OF THE DRAWING

The sole Figure is an axial sectional view of a preferred embodiment of the invention.

DESCRIPTION OF THE PREFERRED EMBODIMENT

The nozzle has a housing 1 defining an antechamber 1*a*. The housing 1 is provided with a downwardly oriented nipple 2 at the bottom for the introduction of a first fluid, such as water. For this purpose the nipple 2 is connected to a circulating pump (not shown). In the region of the top, there is a nipple 3 for the intake conduit for a second fluid, such as air. The nipple 3 is arranged in such a manner that it opens obliquely from the top to the bottom into the antechamber 1*a*. The nipple 3 is connected with a sleeve element 4 which projects axially into antechamber 1*a* and which, is a separate component screwed into an appropriate screw-in connection 5 of the housing 1. The sleeve 4, which is open at both ends, extends substantially through the entire antechamber 1*a* and its front end is provided with an external spherical sealing face 6.

The entire nozzle is inserted from the interior of the tub through an opening in tub wall 7, with the free edge 8 of housing 1 resting on and extending over the interior face 9 of the tub. By means of a sleeve nut 10 which can be screwed onto a corresponding threaded attachment 11 on the exterior of 1, the entire arrangement is fixed and sealingly clamped into the opening of tub wall 7.

A spherical nozzle body 13 is held in antechamber 1*a* in a holding ring 12 which is screwed into the housing 1 from the interior of the tub. Nozzle body 13 is held in holding ring 12 by way of a corresponding supporting and sealing face 14 on the one side and an adjustment ring 15 screwed into holding ring 12 and provided with a corresponding supporting and sealing face 16 so as to be sealed but able to pivot freely back and forth between limit positions shown in phantom lines.

Within its spherical region, nozzle body 13 is provided with a collar 17 which is oriented toward the sealing face 6 of sleeve 4 and whose free edge forms a sealing face cooperating with the to sealing face 6 of the sleeve 4.

As shown in the drawing, the free cross section between sealing face 6 and the sealing face of collar 17, which simultaneously defines the passage cross section for the water flowing through antechamber 1*a*, can be changed by turning holding ring 12. The upper half of nozzle body 13 indicates the position providing the largest passage cross section, while the lower half shows the position for the smallest cross section. The arrangement may be dimensioned so that collar 17 lies completely against sealing face 6, completely sealing it against the flow of water.

As indicated by the lower portion of the illustrated nozzle body, the face of the spherical portion of nozzle body 13 and the sealing face 6 of the sleeve 4 have such dimensions that, in the region of the closed position, their center points M practically coincide. In this way, it is ensured that, particularly in the closed position and in a setting providing only a small passage cross section, proper pivotability of nozzle body 13 is possible, with an annular cross section remaining which is practically the same size as the passage cross section. This ensures proper jet formation even at reduced throughput.

The edge 8 of the housing 1 passing beyond tub wall 7 on the interior face 9 of the tub is additionally covered on the interior by a decorative covering ring 18. The decorative covering ring may be made of one piece. The decorative covering ring has an external part 18' which may be of metal or a metallized plastic and which is firmly connected with a separate screw ring 18''.

On its side facing the interior of the tub, holding ring 12, like screw ring 18'', is provided with setting tool receiving depressions 19 or 20 so that adjustment in throughput quantity can be effected by turning holding ring 12 by means of an appropriate key.

It will be understood that the above description of the present invention is susceptible to various modifications, changes and adaptations, and the same are intended to be comprehended within the meaning and range of equivalents of the appended claims.

I claim:

1. A nozzle assembly for discharging a mixture of first and second fluids, comprising (a) a housing defining an inner space constituting an antechamber; said housing including means defining first and second inlets for introducing the first and second fluids, respectively, into said antechamber;

(b) a sleeve being disposed in said antechamber and being affixed to said housing; said sleeve being coupled to said second inlet for receiving the second fluid from said second inlet; said sleeve having a length, an outlet orifice remote from said second inlet, an exterior surface and a spherical sealing face formed on said exterior surface;

(c) a holding ring disposed in said antechamber and surrounding said sleeve;

(d) securing means for securing said holding ring to said housing for displacement relative to said sleeve in a direction parallel to said length thereof;

(e) force-receiving means provided on said holding ring and being accessible from an exterior of said housing for engagement by a force-exerting member to displace said holding ring parallel to the length of said sleeve;

(f) a nozzle body situated at least partially in said antechamber; said nozzle body having a spherical member and a nozzle outlet member defining a nozzle bore and being directed outwardly of said housing at one side thereof; said spherical member being hollow and being surrounded by said holding ring; said sleeve projecting into said spherical member and said outlet orifice of said sleeve opening into said nozzle outlet; said nozzle body further including a sealing face situated inside the spherical member and delimiting the nozzle bore; said sealing face of said nozzle body cooperating with the spherical sealing face of said sleeve for determining therewith an annular gap constituting a flow passage area through which the first fluid is introduced from the antechamber into the nozzle outlet member; and (g) retaining means for holding said spherical member captive in said holding ring; said retaining means permitting a pivotal motion of said nozzle body about a center of said spherical member; said retaining means coupling said nozzle body to said holding ring such that said nozzle body and said holding ring move substantially as a unit upon displacement of said holding ring relative to said sleeve along the length thereof; a size of said gap depending from a position of said holding ring relative to said sleeve; said holding ring having a limit position in which said gap is reduced to zero by a sealing contact between said spherical sealing face of said sleeve and the sealing face of said nozzle body; in said limit position said center of said spherical member coinciding with a center of said spherical sealing face of said sleeve.

2. A nozzle assembly as defined in claim 1, wherein said securing means for securing said holding ring to said housing comprises a screw connection having matching threads on an external face of said holding ring and an inner face of said housing, whereby displacement of said holding ring parallel to said length of said sleeve is effected by turning said holding ring relative to said housing.

3. A nozzle assembly as defined in claim 1, wherein said retaining means for holding said spherical member captive in said holding ring includes (a) a circumferential sealing face provided on said holding ring and being in circumferential engagement with an outer face of said spherical member; and (b) an adjustment ring threadedly coupled to said holding ring and circumferentially engaging the outer face of said spherical member at a location spaced from said circumferential engagement between said sealing face provided on said holding ring and said outer face of said spherical member.

4. A nozzle assembly as defined in claim 1, wherein said second inlet is oriented as an oblique angle to said length of said sleeve.

5. A nozzle assembly as defined in claim 1, further comprising a decorative covering ring attached to said housing and surrounding said nozzle outlet member.

6. A nozzle assembly as defined in claim 5, wherein said decorative covering ring comprises an annular decorative covering portion and an annular screw-in portion secured to the annular decorative covering portion and threadedly engaging said housing; said annular screw-in portion having a torque-receiving means being accessible from the exterior of said housing for engagement by a torque-exerting member to turn said annular screw-in portion relative to said housing.

* * * * *